US006554672B2

(12) United States Patent
Dunham et al.

(10) Patent No.: US 6,554,672 B2
(45) Date of Patent: Apr. 29, 2003

(54) FLAT PANEL DISPLAY, METHOD OF HIGH VACUUM SEALING

(75) Inventors: Craig M. Dunham, Boise, ID (US); Seungwoo Lee, Boise, ID (US); Jim Browning, Boise, ID (US); Michel Garcia, Puyricard (FR)

(73) Assignee: Micron Technology, Inc., Boise, ID (US)

( * ) Notice: Subject to any disclaimer, the term of this patent is extended or adjusted under 35 U.S.C. 154(b) by 201 days.

(21) Appl. No.: 09/804,026

(22) Filed: Mar. 12, 2001

(65) Prior Publication Data

US 2002/0125816 A1 Sep. 12, 2002

(51) Int. Cl.[7] ..... H01J 9/00; H01J 9/24

(52) U.S. Cl. ..... 445/25; 445/24; 445/53; 445/54; 313/495; 313/496; 313/582

(58) Field of Search ..... 445/24, 25, 38, 445/39, 54; 313/495, 496, 497, 582

(56) References Cited

U.S. PATENT DOCUMENTS

| | | | | | |
|---|---|---|---|---|---|
| 4,018,490 | A | * | 4/1977 | Berkenblit et al. | 445/25 |
| 5,643,033 | A | | 7/1997 | Gnade et al. | 445/24 |
| 5,672,083 | A | * | 9/1997 | Curtin et al. | 445/25 |
| 5,807,154 | A | | 9/1998 | Watkins | 445/25 |
| 5,869,919 | A | * | 2/1999 | Sato et al. | 313/496 |
| 5,985,069 | A | | 11/1999 | Kawabe et al. | 156/109 |
| 5,986,409 | A | | 11/1999 | Farnworth et al. | 313/496 |
| 6,236,159 | B1 | * | 5/2001 | Inoue et al. | 313/582 |

FOREIGN PATENT DOCUMENTS

| | | | | |
|---|---|---|---|---|
| JP | 09304783 A | * | 11/1997 | G02F/1/1339 |
| JP | 2002158475 A | * | 5/2002 | H05K/7/20 |
| WO | WO 9917154 A1 | * | 4/1999 | G02F/1/1341 |

OTHER PUBLICATIONS

"SAES GETTERS—Evaporable Getters", www.saesgetters.com/pr1.htm, Nov. 30, 1999.

"SAES GETTERS—Nonevaporable Getters (NEG)" www.saesgetters.com/pr2.htm, Nov. 30, 1999.

"Frit Solder Glass Vehicle", www.thompson–ato.com/frit.htm, Nov. 29, 1999.

"Glass Transfer Tapes", www.vitta.com/gtapes.html, Nov. 29, 1999.

"The Challenge of Flat Panel Display Sealing," Semiconductor International, p. 109, Jan. 1996.

* cited by examiner

*Primary Examiner*—Kenneth J. Ramsey
*Assistant Examiner*—M. Santiago
(74) *Attorney, Agent, or Firm*—Knobbe, Martens, Olson & Bear, LLP

(57) ABSTRACT

An evacuated cavity is hermetically sealed between a baseplate and faceplate of a flat panel display. Melting a glass powder, or frit, on the perimeter of the viewing area forms the hermetic seal. After melting the frit, a first fluid is circulated through the cavity to speed cooling. To further expedite the cooling of the flat panel display, a second fluid flows externally along the contour of the flat panel display to insure that the cooling is uniform and thereby avoid thermal shock.

29 Claims, 7 Drawing Sheets

FLAT PANEL DISPLAY, METHOD OF HIGH VACUUM SEALING

FIELD OF THE INVENTION

This invention relates generally to sealing flat panel displays, and more particularly, to cooling flat panel displays during a thermal sealing process.

BACKGROUND OF THE INVENTION

Cathode ray tube (CRT) displays are commonly used in display devices such as televisions and desktop computer screens. CRT displays operate as a result of a scanning electron beam from an electron gun striking phosphors resident on a distant screen, which in turn increase the energy level of the phosphors. When the phosphors return to their original energy level, they release photons that are transmitted through the display screen (normally glass), forming a visual image to a person looking at the screen. A colored CRT display utilizes an array of display pixels, where each individual display pixel includes a trio of color-generating phosphors. For example, each pixel is split into three colored parts, which alone or in combination create colors when activated. Exciting the appropriate colored phosphors thus create the color images.

On the other hand, flat panel displays are becoming more popular in today's market. These displays are being used more frequently, particularly to display the information of computer systems and other devices. Typically, flat panel displays are lighter and utilize less power than conventional CRT display devices.

There are different types of flat panel displays. One type of flat panel display is known as a field emission display (FED). FEDs are similar to CRT displays in that they use electrons to illuminate a cathodoluminescent screen. The electron gun is replaced with numerous (at least one per display pixel) emitter sites. When activated by a high voltage, the emitter sites release electrons, which strike the display screen's phosphor coating. As in CRT displays, the phosphor releases photons which are transmitted through the display screen (normally glass), displaying a visual image to a person looking at the screen. Each pixel can be formed by a trio of color-generating phosphors, each associated with a separate emitter.

In order to obtain proper operation of the flat panel display, it is important for an FED to maintain an evacuated cavity between the emitter sites (acting as a cathode) and the display screen (acting as a corresponding anode). The typical FED is evacuated to a reduced atmospheric pressure of about $10^{-6}$ Torr or less to allow electron emission. In addition, since there is a high voltage differential between the screen and the emitter sites, the reduced pressure is also required to prevent particles from shorting across the electrodes.

Generally, the assembly of a flat panel display comprises a baseplate and a faceplate that are physically bonded together in forming a hermetic seal. For example, a glass powder, or frit, is placed in a continuous pattern along the outside perimeter of the display viewing area and melted at elevated temperatures to provide the desired hermetic seal. Typically, the cavity between the baseplate and faceplate is evacuated through an opening while a thermal cycle melts the frit. Once the display is sealed, it is generally important to uniformly cool the display assembly to minimize any thermal stress or shock that may result from immediate exposure to ambient temperature.

To achieve uniform cooling of the display, however, using conventional methods such as conductive cooling takes long periods of time that can not be afforded in a manufacturing environment. Accordingly, there exists a need for a more rapid cooling process during high vacuum sealing of a flat panel display assembly.

SUMMARY OF THE INVENTION

These and other needs are satisfied by several aspects of the present invention.

In accordance with one aspect of the invention, a method is provided for high vacuum sealing a flat panel display. The method includes lining the edges of a first component plate with a bonding material. A second component plate is positioned over the first component plate. The bonding material is thus sandwiched between the component plates, defining a cavity between the plates. The bonding material between the component plates is heated, followed by channeling a cooling fluid through the cavity. The cooling fluid has a lower temperature than the component plates. The cavity is thereafter evacuated.

In accordance with another aspect of the present invention, a method for manufacturing a flat panel display. The method includes forming a flat panel display assembly with an internal cavity. The assembly is thermally processed in a processing chamber. After thermal processing, a first fluid flows through the cavity, cooling inner surfaces of the assembly by convection. Simultaneously, a second fluid flows within the processing chamber, cooling outer surfaces of the assembly by convection. The cavity can then be sealed.

In accordance with another aspect of the invention, a method is provided for cooling a flat panel display assembly that includes at least two component plates. Cooling is conducted after melting a frit to bond the plates together and define a cavity between the plates. The cooling method includes simultaneously supplying heated gas to inside and outside surfaces of the flat panel display assembly while gradually cooling the gas.

In accordance with another aspect of the present invention, a vacuum-sealed flat panel display is provided. The display includes a middle plate spaced between an upper plate and a lower plate. An upper cavity is thus defined above the middle plate, while a lower cavity is defined below the middle plate. In addition, a divider block extends between the middle plate and the rear plate. The block divides the lower cavity into two compartments, each of the which communicate with the upper cavity through at least one opening in the middle plate.

BRIEF DESCRIPTION OF THE DRAWINGS

These and further aspects of the invention will be readily apparent to those skilled in the art from the following description and the attached drawings, which are meant to illustrate and not to limit the invention, and wherein.

DETAILED DESCRIPTION OF THE PREFERRED EMBODIMENT

It will be appreciated that, although the preferred embodiments are described with respect to FED devices, the methods taught herein are applicable to other flat panel display devices, such as liquid crystal displays (LCDs), organic light emitting devices (OLEDs), plasma displays, vacuum fluorescent displays (VFDs) and electroluminescent displays (ELDs). The skilled artisan will also readily appreciate that the materials and methods disclosed herein will have application in a number of other contexts where units are assembled and sealed at elevated temperatures.

Figure 1:
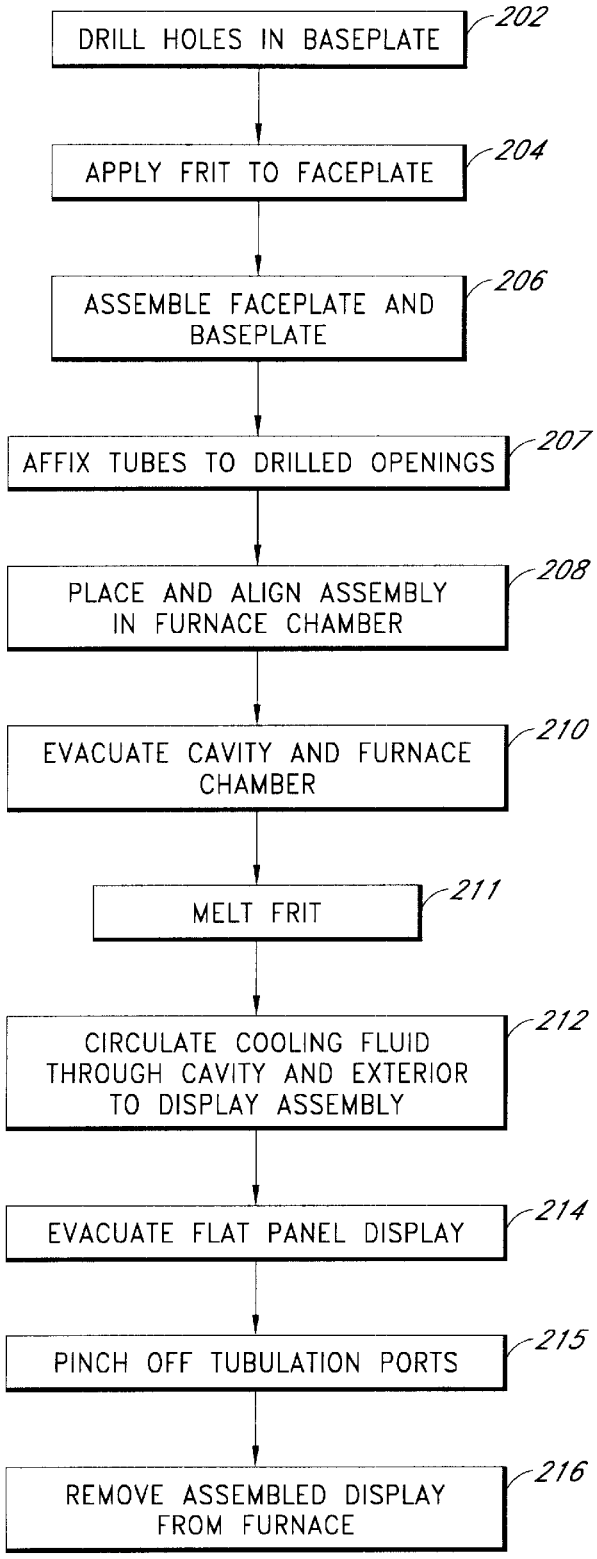
FIG. 1 is a flow chart illustrating a method for high vacuum sealing a flat panel display in accordance with preferred embodiments of the present invention.

FIG. 1 is a flow chart exhibiting a preferred process for high vacuum sealing a flat panel display. As shown, the process begins with drilling 202 at least two holes or openings through a baseplate. The drilled holes preferably include holes proximate opposite edges of the baseplate, more preferably proximate diagonally opposite corners. In other arrangements it will be understood that holes can also be formed in the faceplate or a side surface of the display to be assembled.

Following the drilling 202 of holes, a bond material is applied 204 in a pattern that will form a seal between the plates when assembled. The bond material, comprising a frit (glass powder) in the illustrated embodiments, is patterned around the edges of the faceplate, for example, by mixing the frit into a paste and then dispensing or screen printing the frit. In the preferred embodiment, the frit is preferably mixed into a paste and dispensed around the perimeter edges of the faceplate and/or backplate (see embodiment below), thus avoiding oxidation of the cathode on the baseplate while the frit is fired in air before assembly. The skilled artisan will readily appreciate that the bonding material can alternatively be applied to the baseplate (if oxidation of the cathode can be prevented) or to sidewalls on flanges extending from one of the baseplate and faceplate.

Subsequently, the flat panel display is assembled 206 by aligning the faceplate over the baseplate to sandwich the bonding material between the faceplate and baseplate. The skilled artisan will appreciate that spacers maintain a uniform distance between the plates. As a result, a cavity is formed between the faceplate and the baseplate, which will allow the flat panel display to function.

Following the assembly 206 of the flat panel display, a tube is affixed 207 to each of the drilled holes of the baseplate. The tubes can be affixed by using the same or similar frit that was used between the faceplate and baseplate. With the tubes affixed, the drilled holes can serve as input and output ports.

The flat panel display assembly is placed 208 in a chamber, preferably a furnace chamber. The furnace chamber preferably comprises a first input opening and a first output opening to function as a chamber fluid dispenser and chamber fluid exhaust, respectively.

The furnace chamber also preferably comprises a second input opening and second output opening. Preferably, the input and output ports of the flat panel display assembly are connected to communicate with the second input opening and the second output opening of the furnace chamber, thus forming input and output tubulation ports.

After placing 208 and aligning the flat panel display assembly within the preferred furnace chamber, a vacuum is preferably applied to evacuate 210 the furnace chamber and the cavity between the faceplate and baseplate. The furnace chamber can be evacuated by any suitable means, such as conventional vacuum pumping. In this case the inside cavity of the flat panel display is preferably also evacuated, preferably by similar vacuum pumping means through the tubulation ports.

In other arrangements, a reducing atmosphere (e.g., $H_2$, CO, etc.) can be maintained within the flat panel display and/or in the furnace, minimizing the risk of oxidizing devices during subsequent thermal processing.

After the furnace chamber and the flat panel display cavity are adequately evacuated 210 or filled with a reducing gas, the temperature within the furnace chamber is elevated high enough to melt 211 the frit sandwiched between the faceplate and the baseplate. The melted frit seals the inside flat panel display cavity from the outside environment. The skilled artisan will readily appreciate that other bonding processes may also require thermal or other energy input.

Once the frit is melted 211 and the flat panel display assembly is sealed off, a cooling fluid is circulated 212 within the cavity, preferably by pumping fluid into the input tubulation port(s) through the cavity and out the output tubulation port(s). Preferably, the ports are arranged to achieve uniform convective cooling within the flat panel display assembly. The fluid, preferably a gas, also preferably comprises a non-oxidizing agent such as nitrogen, argon, etc., to protect the internal components of the flat panel display from oxidation. At the same time, to facilitate uniform cooling across the flat panel display assembly, cooling gas is also preferably circulated within the furnace chamber to provide controlled, convective cooling to the outside of the assembly.

In the final hermetically sealed condition, the components of the flat panel display are subjected to a substantial amount of stress due to the pressure differential between the inside and the outside of the assembly. Accordingly, a similar pressure differential between the inside and outside of the flat panel display during the thermal cycle is most preferably applied. The pressure differential can be applied by evacuating the display after the frit has sealed the package and the temperature has somewhat reduced, such that the frit is solidified. Alternatively, the furnace can be pressurized during the thermal cycle prior to final evacuation of the display. This allows the components of the flat panel display to be subjected to stresses similar or equal to those that the assembly will be subjected to in the final sealed condition. In other words, this configuration allows for the flat panel display to be pre-stressed or conditioned during the sealing process.

Following the cooling 212 of the flat panel display, the inside cavity is preferably evacuated 214 by vacuum pumping through the tubulation ports of the flat panel display. The input and output ports of the flat panel display are pinched off 215 to seal the inside cavity from the outside environment. Pinch-off heaters elevate the temperature of the evacuated input and output ports enough to collapse the ports and seal the openings. The vacuum-sealed flat panel display can then be removed 216 from the furnace chamber.

The sealing process of the preferred embodiments will now be described in more detail with reference to FIGS. 2–7.

Figure 2A:
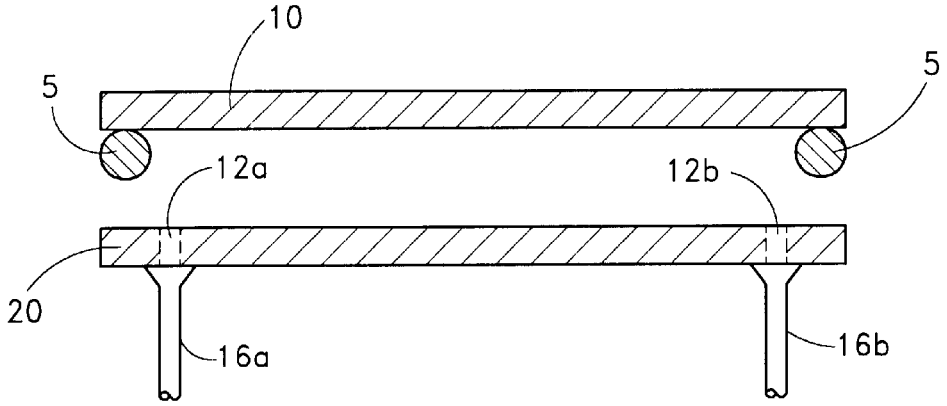
FIG. 2A is a schematic cross-section of an unassembled flat panel display, constructed in accordance with a first embodiment of the present invention, including a faceplate and a baseplate.

With reference initially to FIG. 2A, components of an unassembled flat panel display are shown. The main components of a flat panel display include a frontal support element or faceplate 10 and a rear support element or baseplate 20, both which are preferably manufactured of a glass compound. In the illustrated FED embodiment, the baseplate 20 comprises cathode emitter tips while the faceplate includes an anode element and photo-luminescent coating, such as phosphors.

At least two holes 12*a* and 12*b* are formed through the baseplate 20. Tubes 16*a* and 16*b* are affixed therebelow by any suitable means, forming input and output ports to the interior of the assembly. While illustrated schematically with two holes 12*a*, 12*b*, the skilled artisan will appreciate that multiple holes can be peripherally positioned to obtain uniform flow from inlet ports to outlet ports across the inner surfaces of the flat panel display. Most preferably, two holes are positioned proximate diagonally opposite corners.

Additionally, a bond material is preferably placed on the perimeter edges of the faceplate 10. The preferred bond material is a frit 5, comprising glass powder and other additives that, when mixed into a paste, is advantageously used to make a thermally compatible vacuum tight seal between two glass compounds. The frit 5 can be applied using conventional methods.

Figure 2B:
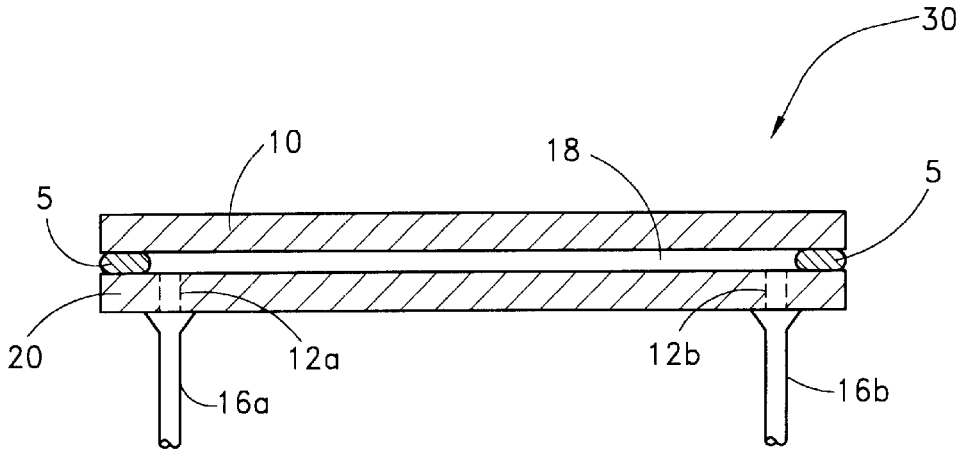
FIG. 2B illustrates a partially assembled flat panel display, with a bond material sandwiched between the baseplate and faceplate of FIG. 2A.

After firing the frit 5, the components of FIG. 2A are then assembled together to form the flat panel display assembly 30, as shown in FIG. 2B. Spacers and alignment markers (not shown) aid in the assembly to produce a uniform space or cavity 18 between the plates. The frit 5 is sandwiched between the faceplate 10 and the baseplate 20, forming a cavity 18 therebetween.

Figure 3:
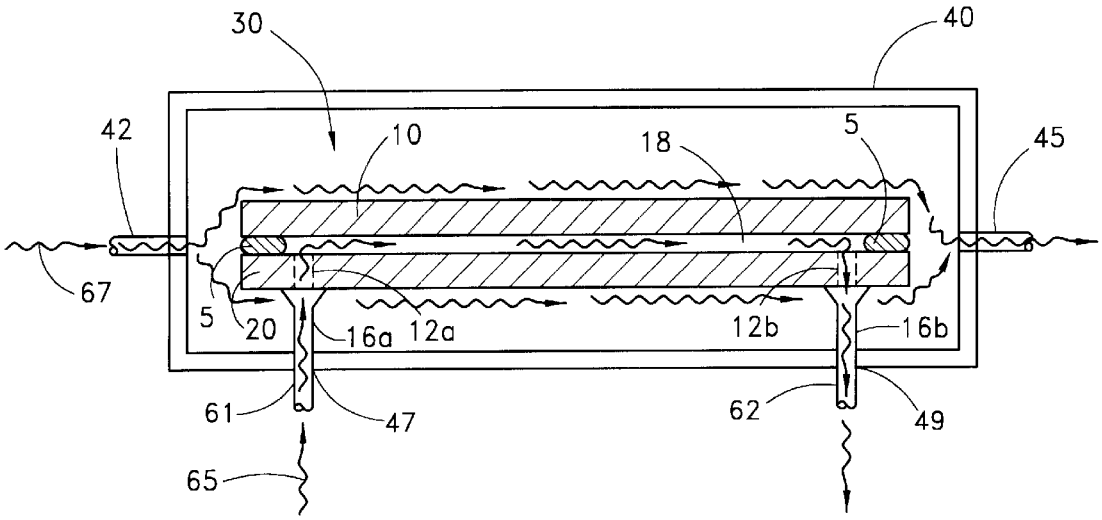
FIG. 3 illustrates the flat panel display of FIG. 2B while cooling inside a furnace chamber.

Prior to or subsequent to the assembly of the flat panel display 30, it is placed inside a chamber, preferably a furnace chamber 40. With reference to FIG. 3, the furnace chamber 40 comprises at least one inlet 42 and at least one outlet 45 for fluid flow and/or evacuation of the chamber during the sealing process. The illustrated furnace chamber 40 further comprises a second input opening 47 and a second output opening 49. The flat panel display 30 is aligned within the furnace chamber 40 so that the tubes 16*a*, 16*b* communicate with the second input opening 47 and second output opening 49, respectively, thus forming an input tubulation port 61 and output tubulation port 62.

For some flat panel display technologies, it is advantageous for thermal processes (for example, to melt the frit as described below) to be conducted in a reducing atmosphere or vacuum to protect the components of the display from oxidation. In the preferred embodiment, once the flat panel display 30 is assembled and aligned within the furnace chamber 40, both the chamber 40 and the cavity 18 are preferably evacuated by any suitable means. Using conventional vacuum pumping, the pressure range within the chamber 40 and the cavity 18 is pumped down to preferably between about $10^{-9}$ Torr and $10^{-5}$ Torr, more preferably between about $10^{-8}$ Torr and $10^{-6}$ Torr. During the pump-down (preferably over 2–3 hours) the chamber 40 temperature is preferably elevated to between about 300° C. and 350° C., more preferably between 320° C. and 330° C. to bake-out any moisture contained within the display package 30. In other arrangements, the cavity 18 can be filled with reducing agents (e.g., $H_2$, CO, etc.) rather than being evacuated.

After both the chamber 40 and cavity 18 are adequately evacuated or filled with reducing gas, the temperature within the furnace chamber 40 is raised to a high enough temperature to melt the frit 5 sandwiched between the faceplate 10 and baseplate 20. By melting the frit 5, the faceplate 10 and the baseplate 20 are effectively bonded to one another, sealing the cavity 18 from the chamber 40. To melt the frit, the temperature within the furnace chamber 40 is preferably elevated to between about 300° C. and 550° C., more preferably between about 400° C. and 500° C. for a preferred duration of between about 15 minutes and 30 minutes, more preferably between about 20 minutes and 25 minutes.

Depending of the design of the flat panel display assembly, an external force can also be applied to the outside of the package assembly during the melting process to maintain alignment of the assembly and to help the frit 5 flow. The external force may be applied utilizing fixed clamps, springs clamps, weights, etc.

Subsequent to thermal sealing of the flat panel display assembly 30, it is generally advantageous to cool the flat panel display assembly 30 to minimize thermal shock resulting from ambient exposure. At the same time, in a manufacturing environment, it is generally desirable to expedite the cooling of the flat panel display assembly 30 to improve production throughput.

Accordingly, an internal cooling fluid 65 is pumped into the input tubulation port 61 and out through the output tubulation port 62 to convectively cool the inside of the flat panel display 30. The cooling fluid also preferably comprises a non-oxidizing agent such as nitrogen or argon, or a reducing agent such as $H_2$ or CO, protecting the internal components of the display from oxidation during the process. Preferably, the cooling fluid is initially heated to a temperature below that of the thermal process by between about 5° C. and 10° C., more preferably between about 10° C. and 20° C. The initial flow of gas is heated to minimize any thermal shock induced by the temperature difference between the flat panel display 30 and the cooling fluid. Band heaters (not shown) or any suitable means as is well known in the art can conduct heating of the cooling fluid.

The cooling fluid 65, comprising argon gas in the illustrated embodiment, is pumped initially at a rate preferably between about 25 sccm and 500 sccm, more preferably between 50 sccm and 100 sccm, at a preferably temperature range between about 300° C. and 500° C., more preferable between about 400° C. and 500° C. Thereafter, the temperature of the cooling gas 65 is decreased at a preferable rate to optimize convective cooling of the flat panel display 30. Preferably, the temperature of the cooling gas 65 is decreased at a rate of between about 5° C./min and 30° C./min, more preferably between about 10° C./min and 20° C./min. Also, to further optimize convective cooling of the flat panel display 30, it may be advantageous to increase the flow rate of the cooling gas 65 as its temperature is being decreased. In the preferred embodiment, the flow rate of the cooling gas 65 is increased preferably increased to between about 100 sccm and 1000 sccm, more preferably between about 250 sccm and 750 sccm. As an example, the flow rate of cooling gas 65 can be increased by between about 10 sccm/min to 20 sccm/min. The skilled artisan will readily appreciate that minimizing thermal shock can be achieved by either or both of controlling the cooling gas temperature and controlling the cooling gas flow rate.

To insure that the cooling of the flat panel display 30 is uniform, it is advantageous to pump an external cooling gas 67 into the furnace chamber 40 to provide controlled, convective cooling to outside surfaces of the flat panel display 30. A preferably inert or non-oxidizing gas, comprising argon in the illustrated embodiment, is pumped into the chamber fluid dispenser 42 at a rate preferably between about 25 sccm and 500 sccm, more preferably between about 50 sccm and 100 sccm. Also, the flow of the external gas 67 is preferably increased at a rate of between about 10 sccm/min and 20 sccm/min. Like the internal cooling gas 65, the temperature of the external cooling gas 67 is constantly kept lower than the temperature of the cooling assembly 30. Moreover, the external cooling gas 67 temperature is preferably the substantially same temperature as the internal cooling gas 65, such that the substrates or plates are uniformly cooled from inside and out and thermal stress cracking is avoided during the aided cool down. Insubstantial differences in actual gas temperature between the internal cooling gas 65 and the external cooling gas 67 may result, for example, by differences in pathlengths from a common heat source to the inner and outer surface of the assembly 30, respectively.

As a result of exposure to cooling fluids 65, 67, the temperature of the flat panel display 30 is desirably brought down to between about 30° C. and 100° C., more preferably between about 30° C. and 50° C., after between about 2 and 3 hours.

Subsequent to the cooling of the flat panel display 30, the cavity 18 is evacuated through the tubulation ports 61 and 62. Uniform evacuation can be aided by switching both ports to the vacuum source by means of conventional switch valves. Alternatively, a reducing agent (not shown) such as hydrogen ($H_2$), carbon monoxide (CO), etc., may be subsequently back-filled into the cavity 18, particularly where inert cooling gas was employed prior to evacuation. Introducing $H_2$, for example, before a final evacuation of the cavity 18 may be advantageous for the emitter tips (not shown) of the flat panel display 30.

Figure 4:
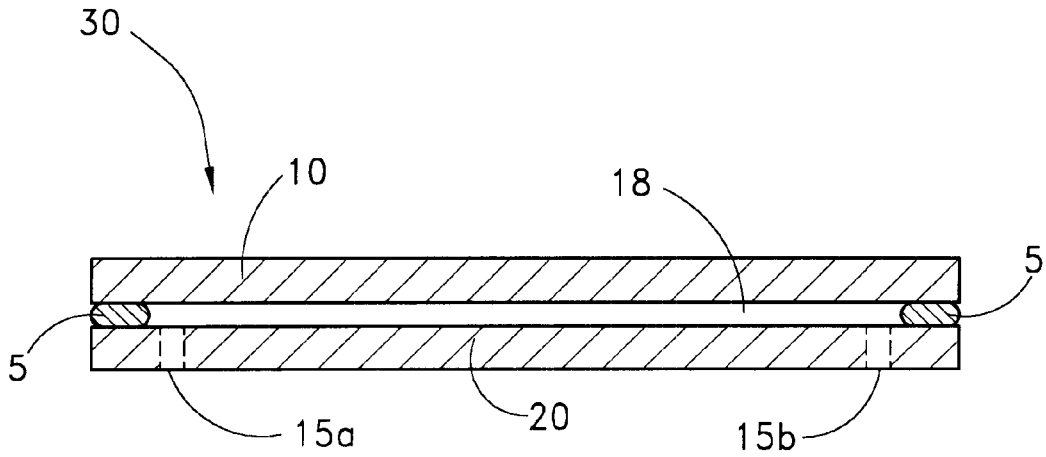
FIG. 4 illustrates the flat panel display of FIG. 3 following vacuum sealing.

With reference to FIG. 4, once the cavity 18 is evacuated of the cooling gas 65 and any reducing agent, the input and output ports 16*a*, 16*b* are pinched off or sealed to effectively seal the inside cavity 18 from the surrounding environment. Pinch-off heaters, or other sealing mechanisms as are well known in the art, are utilized to seal the input and output ports 16*a* and 16*b*. The pinch-off heaters, for example, elevate the temperature of the evacuated tube ports 16*a* and 16*b* high enough to collapse them and form seals 15*a* and 15*b* at the corresponding drilled holes (12*a*, 12*b*). Once cooled, evacuated and sealed, the flat panel display 30 is removed from the furnace chamber 40.

In accordance with a second embodiment, FIG. 5A illustrates components of an unassembled flat panel display 130 comprising a frontal support or faceplate 110, middle support or baseplate 120 and a rear support or backplate 125. This three-piece configuration differs from the two-piece (i.e., faceplate and baseplate) configuration of FIGS. 2–4 in that the baseplate 120 is thinner than the faceplate 110 and an additional backplate 125 is provided.

Figure 5:
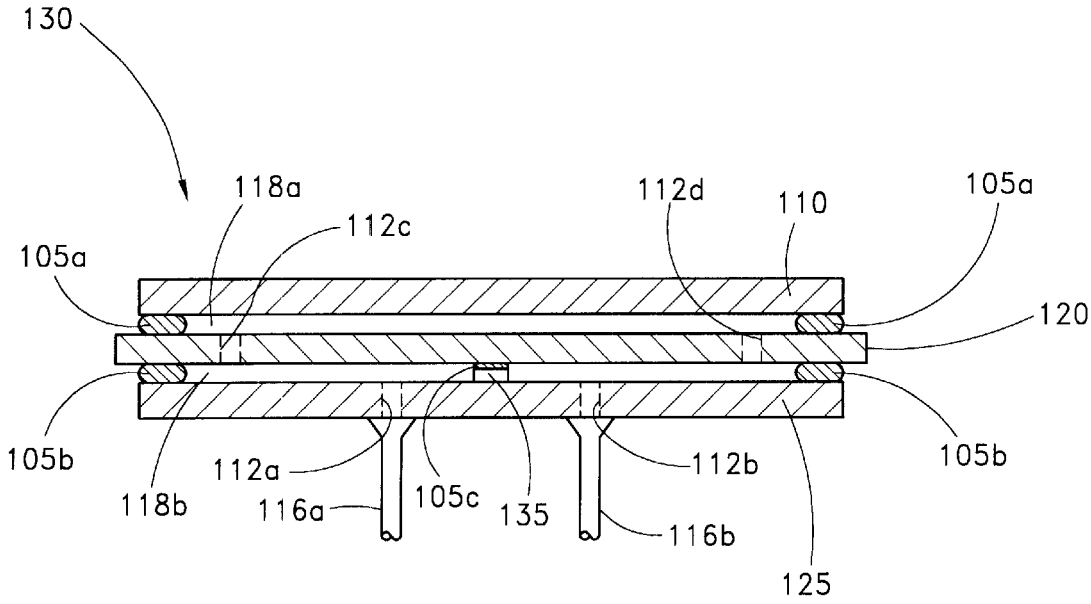
FIG. 5 is a schematic cross-section of an assembled flat panel display, constructed in accordance with a second embodiment of the present invention, including a backplate, baseplate and a faceplate with bonding material between the plates.

FIG. 5 further illustrates similar bond material or frits 105*a*, 105*b* at the perimeter edges of both the backplate 125 and the faceplate 110, which are fired in air prior to assembly. During this firing, the baseplate 120 is not present, avoiding oxidation of the cathode. When assembled, as is illustrated in FIG. 5, the baseplate 120 is sandwiched between the faceplate 110 and the backplate 125 with frits 105*a*, 105*b* on both top and bottom of the baseplate 120. The sandwiching of the three pieces forms a divided cavity, comprising an upper cavity 118*a* and a lower cavity 118*b*, between the faceplate 110 and backplate 125.

Holes 112*a*, 112*b* are drilled through the backplate 125, with tubes affixed to form an input port 116*a* and an output port 116*b*. Additionally, a second set of at least two holes (112*c* and 112*d*) are also drilled through the baseplate 120, which will allow for fluid to be pumped through both sides of the baseplate 120. The holes 112*a*, 112*b* through the backplate 125 are preferably centrally located, whereas the holes 112*c*, 112*d* in the baseplate 120 are preferably peripherally located, as will be better understood from the following discussion.

A divider 135 is most preferably mounted to the interior side of the backplate 125 or baseplate 120 (shown on the backplate 125). This divider 135 preferably extends across one dimension of the assembly 130. An additional frit 105*c* is placed on one side of the divider 135 such that, when assembled, it is sandwiched between the baseplate 120 and the divider 135 and divides the lower cavity 118*b* into two compartments.

Figure 6:
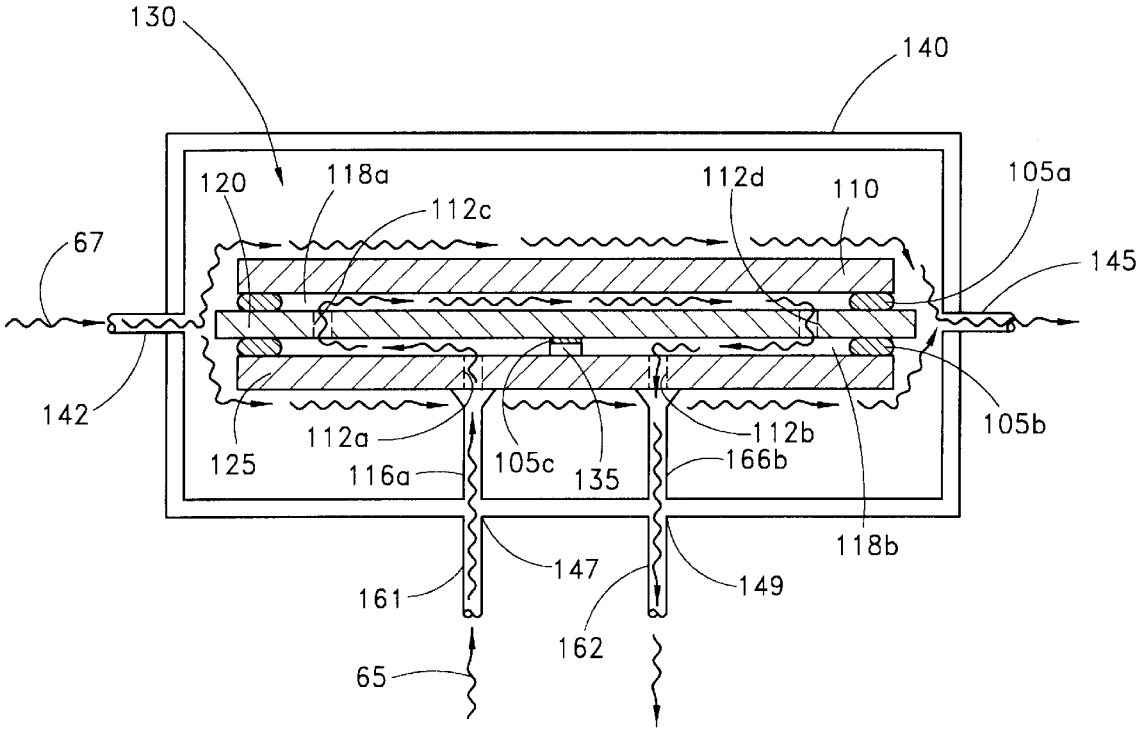
FIG. 6 illustrates the flat panel display of FIG. 5 while cooling inside a furnace chamber.

With reference to FIG. 6, an assembled flat panel display 130 is positioned within a furnace chamber 140, wherein the input and output ports 116*a*, 116*b* correspondingly communicate with the second input and output openings 147, 149 of the furnace chamber 140. As a result, input and output tubulation ports 161, 162 are thus formed.

As mentioned above, for some flat panel display technologies, it is advantageous for thermal processes (for example, to melt the frit as described below) to be conducted in a reducing atmosphere or vacuum to protect the components of the display from oxidation. In the preferred embodiment, once the flat panel display 130 is mounted within the furnace chamber 140, both the chamber 140 and the cavity 118*a*, 118*b* are accordingly evacuated by any suitable means. Using conventional vacuum pumping, the pressure range within the chamber 140 is preferably pumped down slowly to between about $10^{-9}$ Torr and $10^{-5}$ Torr, more preferably between about $10^{-8}$ Torr and $10^{-6}$ Torr. The cavity 118*a*, 118*b* is preferably pumped down to the same pressure ranges. Desirably, the chamber 140 temperature is elevated to between about 300° C. and 350° C., more preferably between 320° C. and 330° C., during pump-down over 2–3 hours to bake-out any moisture contained within the display package 130.

Subsequently, the temperature within the furnace chamber 140 is raised to a high enough temperature to melt the frits 105*a*, 105*b*, 105*c* sandwiched above and below the baseplate 120. By melting the frits 105*a*, 105*b* and 105*c*, the assembly components are effectively bonded to one another, sealing the cavity 118*a*, 118*b* from the chamber 140. To melt the frits 105*a*, 105*b* and 105*c*, the temperature within the furnace chamber 140 is preferably elevated to between about 300° C. and 550° C., more preferably between about 400° C. and 500° C. for a preferred duration of between about 15 minutes and 30 minutes, more preferably between about 20 minutes and 25 minutes.

Subsequent to melting the frits 105*a*, 105*b*, 105*c* at elevated temperatures, it is generally advantageous to cool the flat panel display 130 in a manner that minimizes thermal shock induced from ambient exposure. However, in a manufacturing environment, it is also generally desirable to expedite the cooling of the flat panel display 130 to improve production throughput.

Accordingly, as shown in FIG. 6, cooling fluids 65, 67 are provided to the interior and exterior of the assembly 130 to provide a uniform convective cooling to inside and outside surface of the flat panel display 130. Preferred cooling gas compositions, temperatures and flow rates can be as described for the previous embodiment.

Within the assembly 130, cooling fluid 65 circulates both above and below the baseplate 120 through both portions 118*a*, 118*b* of the cavity by means of the two drilled holes 112*c*, 112*d*. As briefly noted above, the relative positions of the holes 112*a*, 112*b* and holes 112*c*, 112*d*, with respect to each other and to the divider 135, are selected to optimize uniform distribution of the cooling gas 65 in both portions 118*a*, 118*b* of the cavity. In particular, the lower holes 112*a*, 112*b* are preferably positioned proximate the divider 135, whereas the central holes 112*c*, 112*d* are preferably located peripherally. Thus, at least one of the lower holes 112*a*, 112*b* communicates with each of the compartments on either side of the divider 135. Similarly, at least one of the central holes 112*c*, 112*d* communicates with each of the compartments on either side of the divider 135.

During the cooling process, once the frits have solidified enough to seal the inside of the display 130 from the outside, a pre-stressing pressure differential is established between the inside of the display 130 and the chamber 140. The differential can be established by any combination of pressurizing and pumping down the display 130 and chamber 140, but the differential should be equivalent to the final product pressure differential, e.g., about atmospheric in the chamber 140 and about $10^{-6}$ Torr within the display 130.

Figure 7:
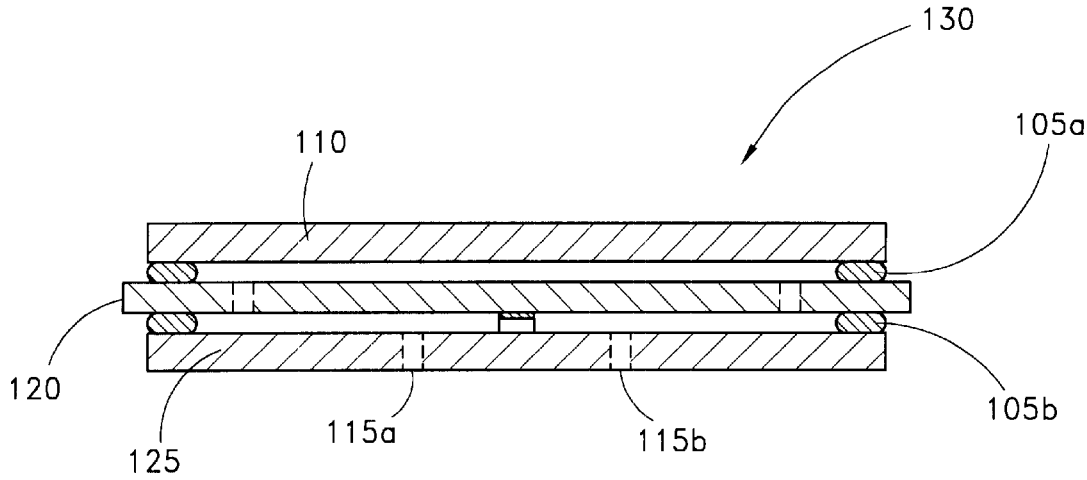
FIG. 7 illustrates the flat panel display of FIG. 6 following vacuum sealing.

Referring to FIG. 7, subsequent to cooling the flat panel display 130, the cavity 118*a*, 118*b* is again evacuated through the tubulation ports 161, 162. Uniform evacuation can be aided by switching both ports to the vacuum source by means of conventional switch valves. The input and output ports 116*a*, 116*b* are then pinched off or sealed to effectively seal the inside cavity 118*a*, 118*b* from the surrounding environment, as described above, forming seals 115*a*, 115*b* at the drilled holes 112*a*, 112*b*, respectively. Once cooled, evacuated and sealed, the flat panel display is removed from the furnace chamber 140.

Several advantages are obtained by the preferred process. For example, circulating fluid to cool by convection more efficiently cools an assembly than by conventional conductive cooling. Fluid pathways formed within the flat panel display allow for an effective circulation of a cooling fluid during a high vacuum sealing process. Additionally, the illustrated arrangements facilitate application of a pressure differential between the inside and outside of a flat panel display, subjecting and conditioning the flat panel display to pressure differentials similar to those of the final sealed product. The same ports used to evacuate the inside of the flat panel display can be used to circulate a fluid to more quickly cool the flat panel displays.

Although this invention has been described in terms of a certain preferred embodiment and suggested possible modifications thereto, other embodiments and modifications may suggest themselves and be apparent to those of ordinary skill in the art are also within the spirit and scope of this invention. Accordingly, the scope of this invention is intended to be defined by the claims that follow.

We claim:

1. A method for high vacuum sealing a flat panel display, comprising:

lining the edges of a first component plate with a bonding material;

positioning a second component plate over the first component plate, wherein the bonding material is sandwiched between the component plates, thereby defining a cavity between the plates;

heating the bonding material between the component plates;

channeling a cooling fluid through the cavity after heating the bonding material, wherein the cooling fluid has a lower temperature than the component plates; and evacuating the cavity after channeling the fluid.

2. The method of claim 1, further comprising providing a second fluid having a lower temperature than the component plates to outside surfaces of the component plates while channeling.

3. The method of claim 2, wherein the second fluid has substantially the same temperature as the cooling fluid.

4. The method of claim 2, further comprising sealing the cavity after evacuating.

5. The method of claim 1, wherein the first component comprises a baseplate and the second component comprises a faceplate including phosphorescent material.

6. The method of claim 1, wherein heating the bonding material comprises heating the component plates in a furnace chamber.

7. The method of claim 1, wherein the bonding material comprises a glass powder frit.

8. The method of claim 1, wherein the fluid comprises an inert gas.

9. The method of claim 1, wherein the fluid comprises a reducing agent.

10. The method of claim 1, wherein channeling the cooling fluid comprises providing the cooling fluid to an inlet opening in one of the component plates and receiving the cooling fluid at an outlet opening in one of the component plates.

11. The method of claim 10, wherein the inlet and outlet openings are positioned proximate opposite edges of the same component plate.

12. The method of claim 1, wherein flat panel display comprises an upper plate, and intermediate plate and a lower plate.

13. The method of claim 12, wherein channeling comprises, in sequence, providing the cooling fluid to a centrally-positioned opening in the lower plate, flowing the fluid to a peripherally-positioned opening in the central plate, flowing the fluid to a second peripherally-positioned opening in the intermediate plate, and flowing the fluid to a second centrally-positioned opening in the lower plate.

14. A method of manufacturing a flat panel display, comprising:

forming a flat panel display assembly with an internal cavity;

thermally processing the assembly in a processing chamber;

flowing a first fluid through the cavity after thermally processing, whereby the first fluid cools inner surfaces of the assembly by convection;

while flowing the first fluid, simultaneously flowing a second fluid within the processing chamber, whereby the second fluid cools outer surfaces of the assembly by convection; and sealing the cavity.

15. The method of claim 14, wherein thermally processing the assembly comprises heat-bonding components of the assembly.

16. The method of claim 15, wherein heat-bonding comprises melting a frit between component plates of the assembly.

17. The method of claim 14, wherein flowing the first fluid comprises supplying the first fluid to a first opening in the assembly and withdrawing the first fluid from a second opening in the assembly.

18. The method of claim 14, wherein sealing the cavity comprises pinching off a tube supplying the first fluid to the assembly.

19. The method of claim 14, wherein the first fluid comprises a reducing agent.

20. The method of claim 14, further comprising evacuating the cavity after flowing the first and second fluids and prior to sealing.

21. The method of claim 14, further comprising evacuating the cavity prior to thermally processing.

22. The method of claim 14, wherein the first and second fluids comprise the same gas.

23. The method of claim 14, wherein flowing the first and second fluids comprise:

heating the first and second fluids to a temperature lower than a temperature of the assembly during thermal processing; and reducing the temperature of the first and second fluids while flowing the first and second fluids.

24. A method of cooling a flat panel display assembly, comprising at least two component plates, after melting a frit to bond the plates together and define a cavity between them, the method comprising:

simultaneously supplying heated gas to inside and outside surfaces of the flat panel display assembly; and gradually cooling the gas while supplying the gas.

25. The method of claim 24, wherein the gas has the same composition inside and outside the flat panel display assembly.

26. The method of claim 24, wherein the gas has a temperature between about 5° C. and 10° C. lower than a temperature of the flat panel display assembly while supplying the gas.

27. The method of claim 24, wherein the flat panel display assembly is cooled from between about 300° C. and 500° C. to between about 30° C. and 50° C. in less than three hours.

28. The method of claim 24, preceding hermetic sealing.

29. The method of claim 28, wherein hermetic sealing comprises evacuating the cavity and pinching off at least two tubes communicating with the cavity.

* * * * *